US005989044A

United States Patent [19]

Miyamoto

[11] Patent Number: 5,989,044

[45] Date of Patent: Nov. 23, 1999

[54] LEVER PARTIAL LOCKING CONSTRUCTION PROVIDED IN A CONTAINER FOR A LEVEL CONNECTOR

[75] Inventor: Takashi Miyamoto, Yokkaichi, Japan

[73] Assignee: Sumitomo Wiring Systems, Ltd., Japan

[21] Appl. No.: 08/899,520

[22] Filed: Jul. 24, 1997

[30] Foreign Application Priority Data

Jul. 25, 1996 [JP] Japan ..... 8-196754

[51] Int. Cl.[6] ..... H01R 13/62

[52] U.S. Cl. ..... 439/157

[58] Field of Search ..... 439/157, 160

[56] References Cited

U.S. PATENT DOCUMENTS

| | | | |
|---|---|---|---|
| 5,328,377 | 7/1994 | Saito | 439/157 |
| 5,362,245 | 11/1994 | Suguro et al. | 439/160 |
| 5,431,573 | 7/1995 | Endo et al. | 439/157 |
| 5,445,530 | 8/1995 | Inoue et al. | 439/157 |

FOREIGN PATENT DOCUMENTS

| | | |
|---|---|---|
| 0 448 053 | of 1991 | European Pat. Off. . |
| 0 549 370 | of 1993 | European Pat. Off. . |
| 2 293 053 | of 1996 | United Kingdom . |

*Primary Examiner*—Steven L. Stephan
*Assistant Examiner*—Barry M. L. Standig
*Attorney, Agent, or Firm*—Anthony J. Casella; Gerald E. Hespos

[57] ABSTRACT

A partial lock portion 11*c* is provided on an inner surface of a connector receptacle 11 provided in a container 10 for a lever connector. A lever 12 is rotatably mounted on the connector housing 13, and is formed with a lock portion 12*a* thereon. When the lever 12 is inclined in one direction, the lock portion 12*a* of the lever 12 is partially locked with the partial lock portion 11*c* of the container 10. When the lever 12 inclined in the other direction, the connector housing 13 is accommodated in the receptacle 11 with the lock portion 11*c* of the lever 12 partially locked with a partial lock portion 13*a* of the connector housing 13.

5 Claims, 3 Drawing Sheets

LEVER PARTIAL LOCKING CONSTRUCTION PROVIDED IN A CONTAINER FOR A LEVEL CONNECTOR

BACKGROUND OF THE INVENTION

1. Field of the Invention

The present invention relates to a lever partial locking construction provided in a container for a lever connector and is particularly designed to partially lock the lever to prevent its movement regardless of the direction in which the lever is inclined when the connector is accommodated.

2. Description of the Prior Art

Conventionally, a plurality of connectors used in an automotive wiring harness are accommodated in a container. The container is secured to a large electrical connection box via a bracket. In recent years, the connectors for an automotive vehicle have had a multitude of contacts, and thereby have become larger. Accordingly, a large force has become necessary to couple these connectors with their mating connectors. Thus, in many cases, a lever connector is employed in which a lever on one connector housing is rotated to couple one connector with the other connector.

In the prior art lever connector, as shown in FIGS. 5(A) and 5(B), a U-shaped lever 3 is rotatably mounted on the outer surface of one connector housing 2A. In a partial lock position with the connector housing 2A shown in FIG. 5(A), a lock projection 3*a* provided on the lever 3 is engaged with a partial lock slot 2A-*a* formed in the outer surface of the connector housing 2A.

The connector housing 2A is fully connected with another connector housing 2B by rotating the lever 3. In this fully connected condition, the lock projection 3*a* of the lever 3 is locked by the engagement of a lock portion 2B-*a* on the connector housing 2B.

The connector housing 2A provided with the lever 3 may be accommodated in a container 5 as shown in FIG. 6. If the lock projection 3*a* of the lever 3 is engaged with the partial lock groove 2A-*a*, there is no likelihood that the lever 3 inadvertently moves inside the container 5. However, depending upon a shipment condition required by a car manufacturer, there are cases where the lever 3 should be inclined to a side (X) opposite to the side where it can be partially locked with the connector housing 3.

In the case that the lever 3 is accommodated in the container 5 with the lever 3 inclined to the side where it cannot be partially locked with the connector housing 2A, the lever 3 is free to move in a direction of the arrow of FIG. 6 and may move during shipment since the lever 3 is not partly locked. Accordingly, the lever may be damaged.

The present invention was developed in view of the above problem and an object thereof is to partially lock a lever in the case that the lever is accommodated in a container, while being inclined in such a direction that it cannot be partially locked with a connector housing.

SUMMARY OF THE INVENTION

According to the invention, there is provided a lever partial locking construction in a container for a lever connector. The lever connector comprises a connector housing, and the container is formed with a connector receptacle for at least partially receiving or containing the connector housing of the lever connector.

A lever is movably mounted on the connector housing of the lever connector, and a lock portion is provided on the lever. The lever partial locking portion of the invention is at a location on the container for engaging the lock portion of the lever.

The connector housing is arrangeable or can be accommodated at least partially in the connector receptacle of the container with the lever moved to a first position, such that the lock portion of the lever is partially locked or engaged with the partial lock portion of the container.

In the case of accommodating in the receptacle with the lever moved, in particular inclined, in such a direction that it cannot be partially locked with the connector housing, since the partial lock portion is provided in the connector receptacle of the container, the lever is positioned and partially locked in the container only by engaging the lock portion of the lever with this partial lock portion.

The connector housing of the lever connector also may include a partial lock portion, as had been included in the prior art. The lock portion of the lever may be locked with the partial lock portion of the connector housing when and if the lever can be rotated into a second position. Since the lock portion of the lever which is lockable with the partial lock portion of the connector housing already is used in the prior art, the invention can be easily realized by using an already existing lever and providing the partial lock portion on the connector receptacle of the container. Thus, the lever can be partially locked in either a first position or second position depending on constraints or conveniences of a particular installation.

According to a preferred embodiment of the invention, when the lever is moved to the second position, the connector housing is held in the connector receptacle with the lock portion of the lever partially locked or engaged with a connector housing partial lock portion of the connector housing.

The lever may be pivotably or rotatably mounted about a support shaft on the connector housing. Further, the lock portion may be provided on an inner surface of the connector receptacle. The partial lock portion may be capable of elastic deflection to be movable on the connector receptacle. The partial lock portion further may be formed with a partial lock slot to be engaged with a lock projection formed on the lever. Most preferably, one or more lock claws are provided on the connector receptacle, in particular on inner surfaces thereof. The lock claws preferably are engageable with one or more lock slots provided on the connector housing when the connector housing is accommodated in the receptacle.

According to a preferred embodiment of the invention, there is provided a lever partial locking construction provided in a container for a lever connector. The lever partial locking construction comprises: a partial lock portion provided on an inner surface of a connector receptacle in a container for a lever connector, and a lock portion provided on a lever rotatably mounted on a connector housing. The connector housing is accommodated in the receptacle with the lever inclined in one direction while the lock portion is partially locked with the partial lock portion.

As is clear from the above description, the partial lock portion is provided on the inner surface of the connector receptacle of the container. Accordingly, in the case that the lever needs to be inclined in a first direction and cannot be partially locked with the connector housing, the lever can be held positioned by engaging the lock portion of the lever with the partial lock portion provided on the inner surface of the receptacle.

When the lever is inclined in the other direction, the connector housing is held in the receptacle with the lock portion thereof partially locked with a partial lock portion of the connector housing.

In the case that the lever needs to be inclined in the opposite or second direction, it is sufficient to lock the lock portion of the lever with the partial lock portion preferably provided on the outer surface of the connector housing. Accordingly, the lever can be partially locked regardless of which direction the lever is inclined. Thus, the lever does not move before the lever connector is coupled with a mating connector and the inadvertent rotation of the lever which may interfere and damage outer members can be prevented.

Further, since the lock portion of the lever used is a lock portion provided also in prior art lever connectors, the invention can be realized easily without increasing production costs by using an already existing lever and by providing only the partial lock portion in the connector receptacle of the container.

These and other objects, features and advantages of the present invention will become more apparent upon a reading of the following detailed description and accompanying drawings.

DETAILED DESCRIPTION OF THE PREFERRED EMBODIMENT

Figure 1:
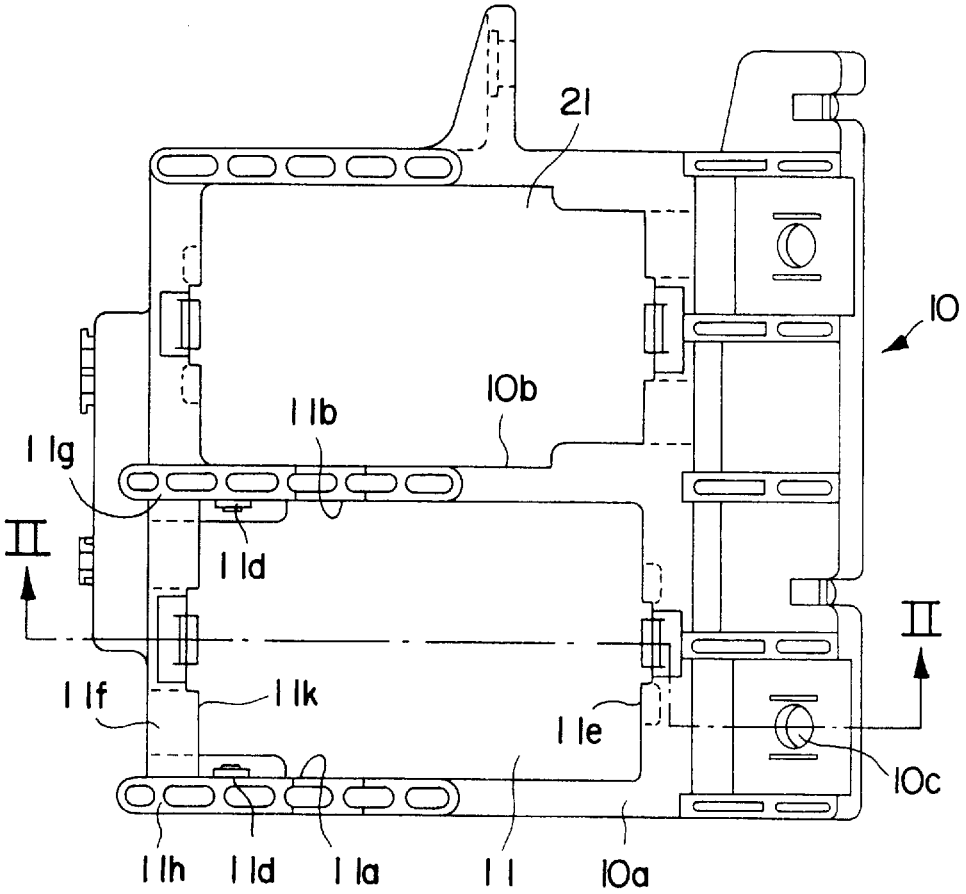
FIG. 1 is a plan view of one embodiment of a container according to the invention.
Figure 2:
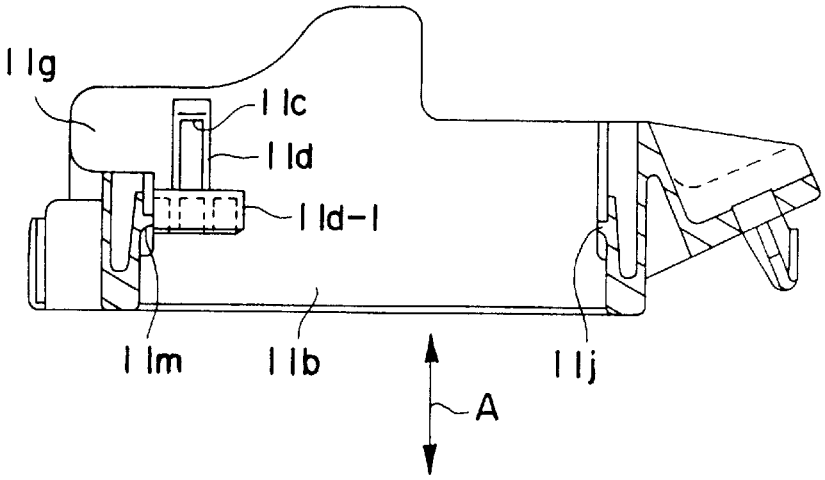
FIG. 2 is a section along II—II of FIG. 1.
Figure 3:
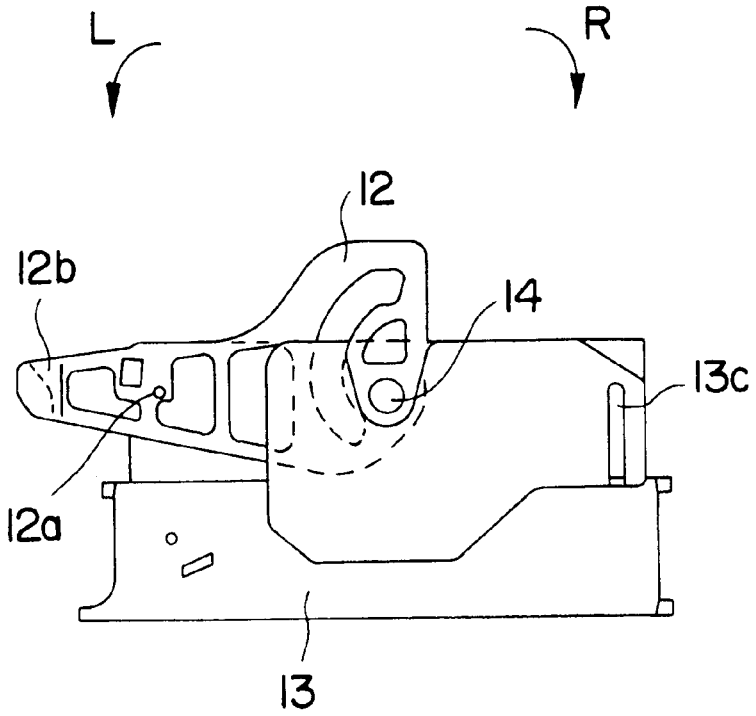
FIG. 3 is a front view of a lever connector to be accommodated in the container.
Figure 4:
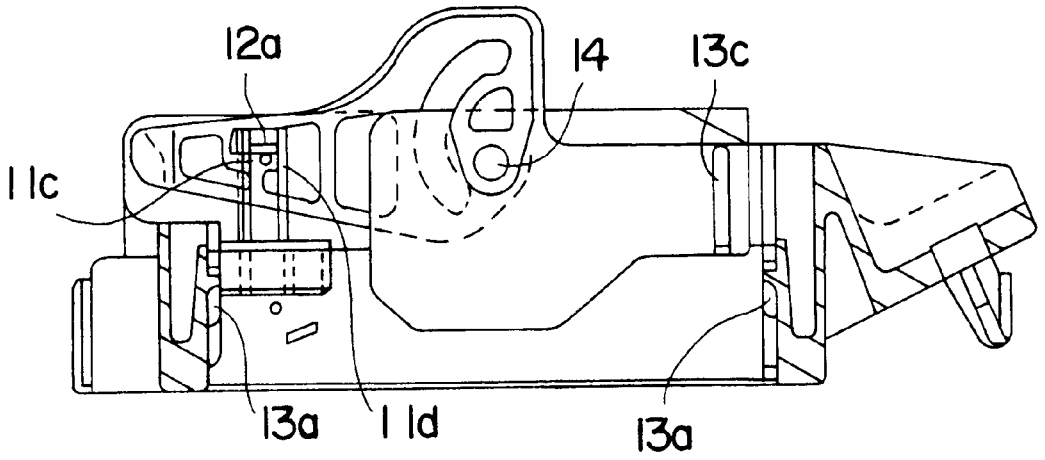
FIG. 4 is a section of the lever connector accommodated in the container while being partially locked.
Figure 5A:
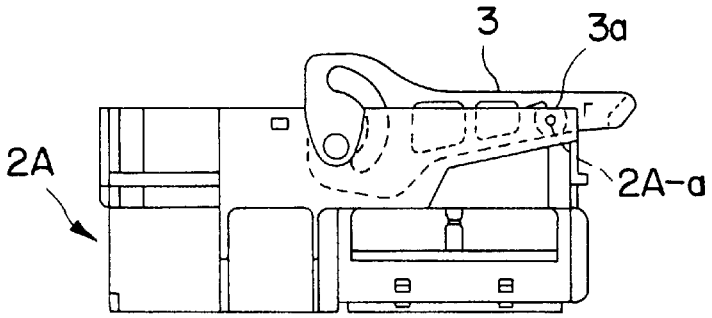
FIG.5(A) PRIOR ART
FIG. 5(A) is a front view of a prior art lever connector with the lever partially locked with the connector housing.
Figure 5B:
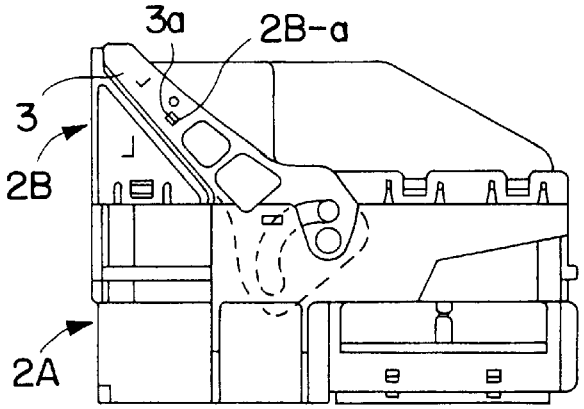
FIG.5(B) PRIOR ART
FIG. 5(B) is a front view of the lever connector fully engaged with a mating connector.
Figure 6:
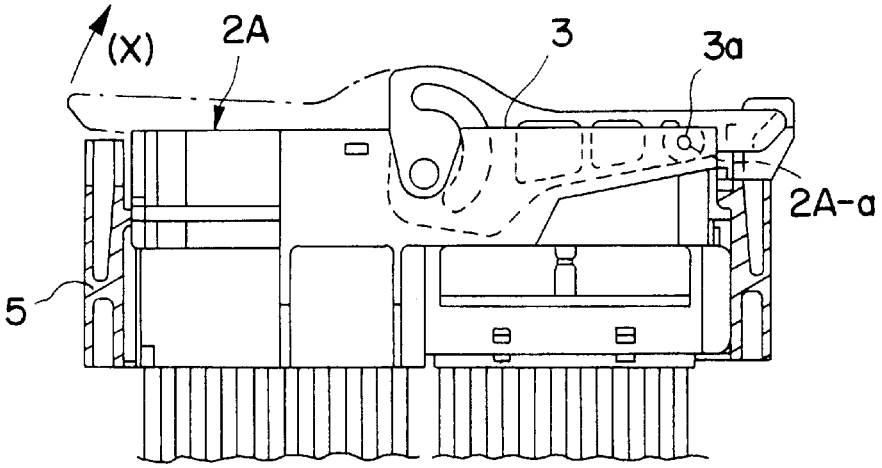
FIG.6 PRIOR ART
FIG. 6 is a section of a prior art lever connector accommodated in a contained while being partially locked.

As shown in FIGS. 1 and 2, a container 10 is provided with two container receptacles 11, 21. A connecter housing 13 is accommodated in the receptacle 11, as shown in FIGS. 3 and 4. The connecting housing 13 has a lever 12 mounted thereon.

The container 10 is unitarily or integrally made, e.g. of a resin. The container 10 has open opposite ends and is formed with an outer wall 10*a* and a partition wall 10*b*. Brackets 10*c* are used to secure the container 10 with an electrical connection box. The brackets 10*c* are provided on the outer surface, in particular of one side part of the outer wall 10*a* as shown in FIG. 1.

The receptacle 11 is enclosed by the outer wall 10*a* and the partition wall 10*b* and preferably has open upper and lower ends. The receptacle 11 is formed such that a configuration defined by the inner surfaces thereof substantially conforms to a configuration defined by the outer surfaces of a connector housing 13 and its horizontal cross section is substantially rectangular. The height of the walls enclosing the receptacle 11 is preferably substantially the same as that of the connector housing 13, so that all outer side surfaces of the connector housing 13 are covered by the connector receptacle 11 when the connector housing 13 is accommodated in the receptacle 11.

In the connector receptacle 11, elastic lock portions 11*d* have their bottom portions connected with lateral inner surfaces 11*a*, 11*b* with respect to an insertion and withdrawal direction A (FIG. 2) of the connector in and from the connector receptacle 11. The lateral inner surfaces 11*a* and 11*b* are substantially opposed to each other at a side substantially opposite to the bracket 10*c*, and project preferably upward therefrom. The lock portions 11*d* are preferably each formed with a partial lock slot 11*c*.

The positions of the partial lock slots 11*c* of the lock portions 11*d* are set such that lock portions 12*a* of the lever 12 are engaged with the partial lock slots 11*c* when the lever 12 mounted on the connector housing 13 is inclined to the left of FIG. 4 after the connector housing 13 is accommodated in the connector receptacle 11.

A notch 11*f* is formed in the left outer wall of the connector, thereby lowering the upper surface thereof, and ribs 11*g*, 11*h* project from the front and rear walls at the substantially opposite sides of the notch 11*f*.

Lock claws 11*j*, 11*m* which engage lock slots 13*a* of the connector housing 13 to fix the connector housing 13, are provided on front and rear (corresponding to left and right sides in FIG. 1) inner surfaces 11*e*, 11*k* of the connector receptacle 11 with respect to the insertion and withdrawal direction A. The lock claws 11*j* and 11*m* engage lock slots 13*a* of the connector housing 13 to fix the connector housing 13 in the connector receptacle 11.

The connector housing 13 on which the lever 12 is mounted is inserted into the connector receptacle 11 of the container 10 through an insertion opening, in particular a bottom end opening. At this time, the lever 12 is rotated about a support shaft 14 to an insertion position, in particular a substantially upright position so as to enable the insertion into the receptacle 11. When the connector housing 13 is accommodated in the receptacle 11, the lock claws 11*j*, 11*m* are engaged with the lock slots 13*a* of the connector housing 13.

It is also necessary to partially lock the lever 12 mounted on the connector housing 13 fixed in the receptacle 11 so as not to move. At this time, the lever 12 is inclined to the left as shown in FIG. 4 (direction L) if it cannot rest on the bracket 10*c*.

Along this inclining direction, a leading end 12*b* of the lever 12 is inserted into the notch 11*f* and have its opposite sides protected by the ribs 11*g*, 11*h*. In this state, the leading end 12*b* of the lever 12 is strongly pushed to come into contact with the notch 11*f*. As a result, the lock projections 12*a* of the lever 12 are inserted into the partial lock slots 11*c* of the lock portions 11*d* on the inner surfaces of the connector receptacle 11. Consequently the lever 12 is partially locked in the container 10. The lever 12 is held in this position and is not freely movable.

On the other hand, in the case that the lever 12 is inclined to the right of FIG. 4 (direction R) where the bracket 10*c* is provided, i.e. in a direction opposite to the above inclining direction, the lever 12 is partially locked by inserting its lock projections 12*a* into partial lock slots 13*c* formed in the outer surfaces of the connector housing 13.

As explained above, the lock projections 12*a* of the lever 12 can be engaged either with the partial lock slots 11*c* of the container 10 when the lever 12 is inclined to the left, or with the partial lock slots 13*c* of the connector housing 13 when the lever 12 is inclined to the right. Therefore the lever 12 can be partially locked using the lock projections 12*a* regardless of whether it is inclined to the left or to the right.

The preceding embodiment was described with respect to a lever being rotatably or pivotably supported on the connector housing. However also a substantially linearly movable lever may be adopted.

What is claimed is:

1. A lever partial locking construction for a lever connector, comprising:

a container having a connector receptacle formed therein;

a connector housing releasably engagable in the connector receptacle of the container;

a lever movably mounted on the connector housing, said lever being movable between first and second positions relative to said connector housing, said lever being formed with at least one lock portion thereon;

a first partial lock portion provided on the container in proximity to said connector receptacle therein, said first partial lock portion being configured and disposed for partially locking with the lock portion of the lever when the lever is moved to the first position relative to the connector housing; and a second partial lock portion formed on the connector housing, said second partial lock portion being disposed and configured for partially locking with the lock portion of the lever when the lever is in the second position relative to the connector housing.

2. A lever partial locking construction according to claim 1, further comprising a support shaft extending from said lever to said connector housing, wherein said movement of said lever relative to the connector housing defines a rotational movement of the lever about said support shaft and relative to the connector housing.

3. A lever partial locking construction according to claim 1, wherein the container defines at least one inner surface defining the connector receptacle, said at least one partial locked portion on the container being disposed on one said inner surface.

4. A lever partial locking construction according to claim 3, wherein the first partial lock portion is elastically deformable relative to adjacent portions of said container.

5. A lever partial locking construction according to claim 4, wherein the first partial lock portion of the container comprises a partial lock slot formed in the container for engagement with the lock projection formed on the lever.

* * * * *